US005810498A

United States Patent [19]

Hirai

[11] Patent Number: 5,810,498

[45] Date of Patent: Sep. 22, 1998

[54] FASTENER ASSEMBLY FOR A FILE

[75] Inventor: Masafumi Hirai, Gardena, Calif.

[73] Assignee: Lion Office Products, Inc., Gardena, Calif.

[21] Appl. No.: 584,921

[22] Filed: Jan. 8, 1996

[51] Int. Cl.[6] ..... B42F 13/06

[52] U.S. Cl. ..... 402/18; 402/8; 402/60

[58] Field of Search ..... 402/8, 14, 18, 402/60, 62

[56] References Cited

U.S. PATENT DOCUMENTS

| | | | |
|---|---|---|---|
| 1,930,648 | 10/1933 | Kline | 402/18 |
| 2,182,058 | 12/1939 | Ross | 402/18 |
| 2,302,035 | 11/1942 | Karlen | 402/18 |
| 4,993,861 | 2/1991 | Blumberg et al. | 402/18 X |

FOREIGN PATENT DOCUMENTS

| | | | |
|---|---|---|---|
| 1486778 | 7/1969 | Germany | 402/18 |

*Primary Examiner*—Willmon Fridie, Jr.
*Attorney, Agent, or Firm*—Koda and Androlia

[57] ABSTRACT

A file having a polypropyrene base sheet and a fastener assembly that includes a polypropyrene base member thermally bonded to the polypropyrene base sheet. A relatively thin polypropyrene sheet, such as a polypropyrene sheet having a thickness of about 0.3 mm or less, is sturdy and is used, thus securing a large mechanical strength to support the fastener assembly. The polypropyrene base member is bonded to a relatively thin polypropyrene base sheet by an ultrasonic bonding. The ultrasonic bonding achieves a strong connection between the polypropyrene member and the relatively thin polypropyrene sheet.

7 Claims, 3 Drawing Sheets

FASTENER ASSEMBLY FOR A FILE

BACKGROUND OF THE INVENTION

1. Field of the Invention

The present invention relates to a file that holds papers, drawings, photos and the like and more particularly to a fastener assembly that is used in combination with a file for binding together various papers, documents, drawings and the like, and a method of making the same.

2. Prior Art

A typical folder made from paper has a foldable cover and a fastener attached to the cover. Papers, letters and the like are bound together and attached to the foldable cover by the fastener. For example, the fastener includes a combination of an elongated metal strip and a metal retainer that engages the elongated metal strip. The elongated metal strip has arm sections that are passed through a pair of apertures provided in the foldable cover and pairs of apertures punched in papers, letters and the like. Then the arm sections of the elongated metal strip are passed through a pair of apertures provided in the metal retainer. The arm sections are bent and stopped by stopper sleeves provided at the metal retainer. Generally, the combination of a paper foldable cover and a metal fastener has a lower durability. Further, the use of metal fasteners necessitates the provision of apertures in the foldable cover, and the punching work requires additional tools, such as a punch tool.

There are files that are made of vinyl. A typical vinyl folder has a foldable cover and a fastener assembly. The fastener assembly may be rivetted to the foldable cover. However, when the cover is made of a relatively thin vinyl sheet, for example, a sheet about 0.3 mm or less thick, rivetting the fastener assembly to the foldable cover does not provide a durable file because such a thin vinyl sheet does not have a mechanical strength practically sufficient to resist an external force, such as sheering or pulling force. Furthermore, vinyl is hazardous to the environment.

SUMMARY OF THE INVENTION

Accordingly, the object of the present invention is to provide a file that obviates the above described limitations of the prior art files.

The present invention provides a file which is durable and easy to manufacture.

In accordance with the present invention, a file has a polypropyrene base sheet and a fastener assembly that includes a polypropyrene base member thermally bonded to the polypropyrene base sheet. A relatively thin polypropyrene sheet, for example, a polypropyrene sheet having a thickness of about 0.3 mm or less, is sturdy and has a large mechanical strength to support the fastener assembly.

In addition, according to the present invention, a polypropyrene base member is bonded to a relatively thin polypropyrene base sheet by an ultrasonic bonding. It has been discovered that the ultrasonic bonding achieves a very strong connection between a polypropyrene member and a relatively thin polypropyrene sheet.

Furthermore, according to the present invention, a polypropyrene base member includes a metal core and a polypropyrene cover covering substantially the entire surface of the metal core. The polypropyrene cover can be relatively thin so that the metal core remains bent as the polypropyrene base member is bent.

In accordance with an embodiment of the present invention, an elongated polypropyrene base member has a central section. The central section includes polypropyrene flanges extending outwardly from both sides of the central section. The polypropyrene flanges are thermally bonded to the polypropyrene base sheet. The polypropyrene flanges are bonded to the polypropyrene base sheet by an ultrasonic bonding. Since the flanges provide a substantially large area for bonding, the fastener assembly and the polypropyrene base sheet are more securely bonded to one another.

In accordance with the present invention, a method of making a file assembly includes the steps of cutting a relatively thin polypropyrene sheet into an specified size and a shape, and thermally bonding a fastener assembly including a polypropyrene member to the polypropyrene sheet. In a preferred embodiment, an ultrasonic bonding method is used to spot-weld the polypropyrene portion of the fastener assembly to the polypropyrene base sheet at spaced intervals. The ultrasonic bonding achieves a very strong connection between a polypropyrene member and a relatively thin polypropyrene sheet.

Other features and advantages of the invention will be apparent from the following detailed description, taken in conjunction with the accompanying drawings which illustrate, by way of example, various features of embodiments of the invention.

DETAIL DESCRIPTION OF THE PREFERRED EMBODIMENTS

Figure 1:
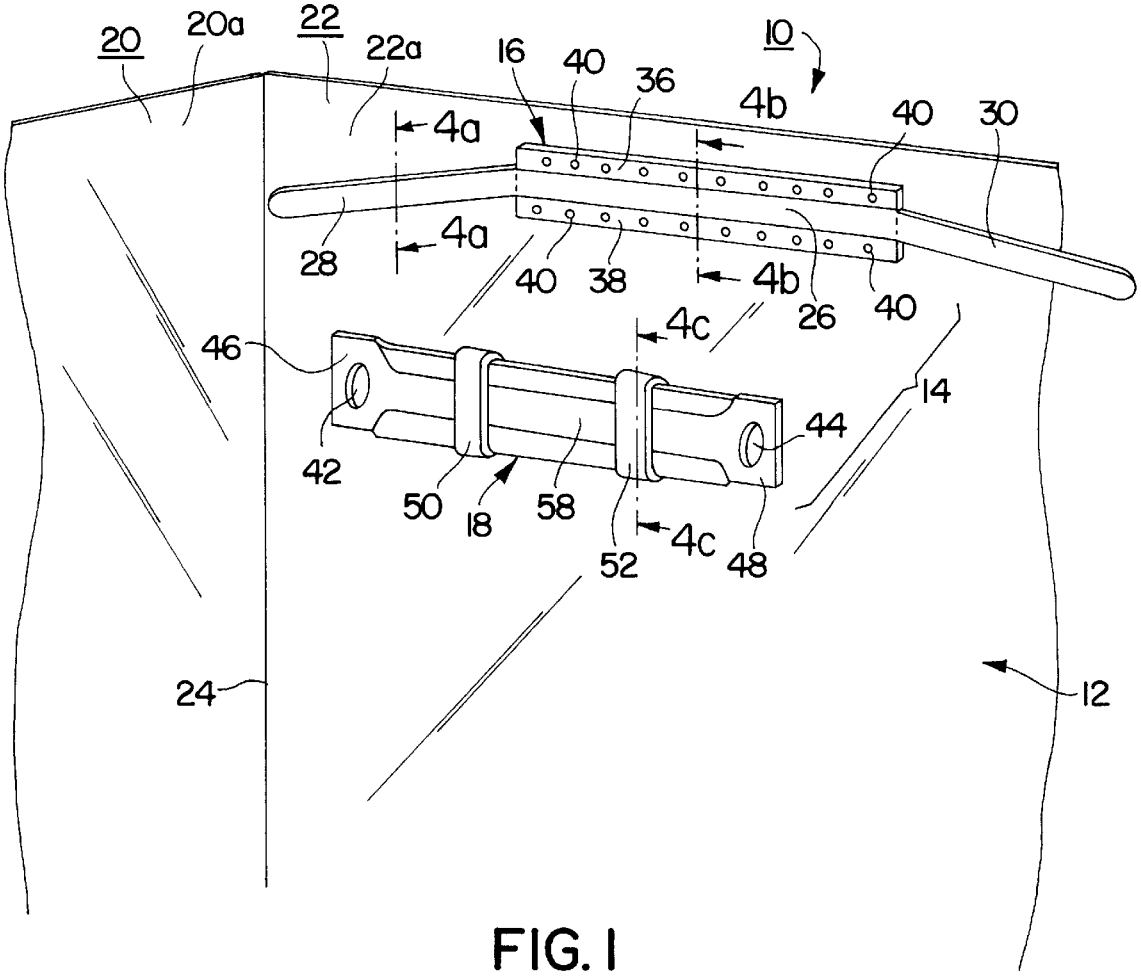
FIG. 1 shows a perspective view of a folder in accordance with a first embodiment of the present invention in which a base member is attached to a polypropyrene sheet and a mating member is detached from the base member.
Figure 2:
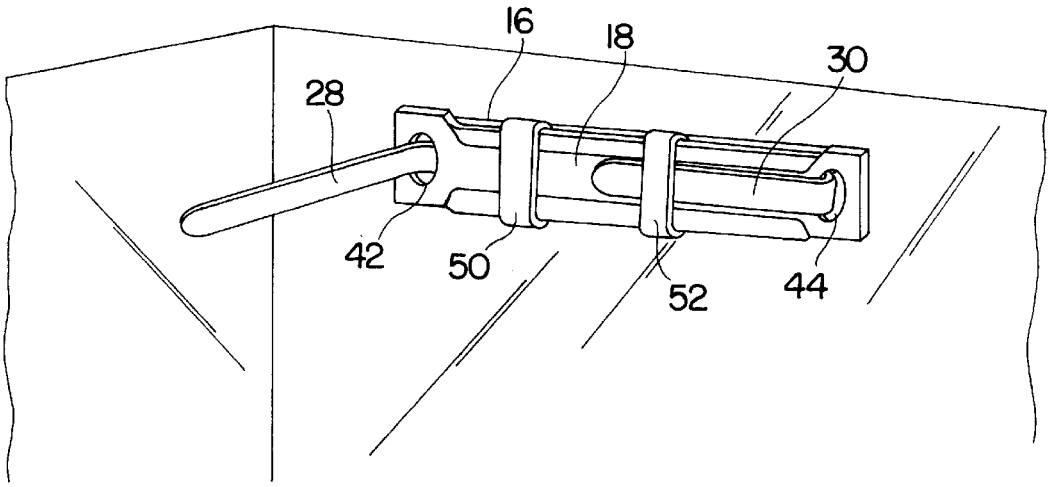
FIG. 2 shows a perspective view of the folder shown in FIG. 1 in which the mating member is coupled to the base member.

A file in accordance with a first embodiment of the present invention is indicated generally at 10 in FIGS. 1 and 2.

The file 10 has a cover sheet 12 and a fastener assembly 14; and the fastener assembly 14 comprises a base member 16 fixed to the base sheet 12 and a retainer member 18. As best shown in FIG. 2, the retainer member 18 is coupled to the base member 16.

In the illustrated embodiment, the cover sheet 12 has a front wall 20 and a rear wall 22; and the front wall 20 has an inner surface 20*a* and the rear wall 22 has an inner surface 22*a*. The front wall 20 and the rear wall 22 can be folded about a fold line 24; and when the front and rear walls 20 and 22 are thus folded, the inner surfaces 20*a* and 22*a* come into contact to each other. The cover sheet 12 and at least a part of the base member 16 of the fastener assembly 14 are made of, for example, polypropyrene. A relatively thin polypropyrene sheet having a thickness of, for example, about 0.3 mm or less, is more sturdy and has a larger mechanical strength to support the fastener assembly 14 as compared with a comparable sheet made of vinyl.

The base member 16 is fixed to the inner surface of the rear wall 22 of the polypropyrene cover sheet 12 in a variety of ways, for example, by means of heat-bonding. The polypropyrene portion of the base member 16 is bonded to the inner surface of the rear wall 22 which is made of the polypropyrene cover sheet 12 by an ultrasonic bonding. It has been discovered that the ultrasonic bonding accomplishes a strong connection between a polypropyrene member and a relatively think polypropyrene sheet.

The base member 16 includes a central section 26 and arm sections 28 and 30 connected to both ends of the central section 26. In the illustrated embodiment, only the central section 26 is affixed to the cover sheet 12. The arm sections 28 and 30 are passed through holes punched in papers (not shown) to be filed in the file 10 and engaged with the retainer member 18 as described later in detail.

Figure 4A:
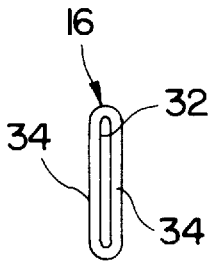
FIG. 4*a* is a cross-sectional view taken along the line 4*a*—4*a* in FIG. 1.
Figure 4B:
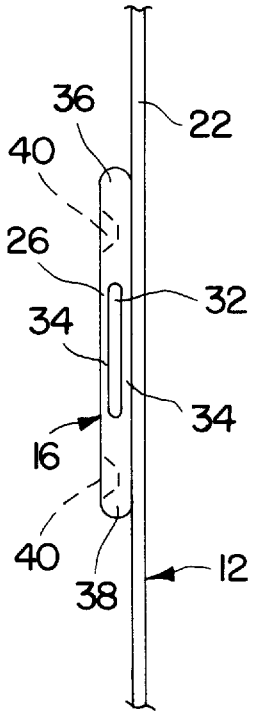
FIG. 4*b* is a cross-sectional view taken along the line 4*b*—4*b* in FIG. 1.

As best shown in FIGS. 4*a* and 4*b*, the base member 16 includes a metal core 32 extending substantially the entire length of the base member 16. The metal core 32 is covered with a polypropyrene cover 34 which covers substantially the entire surface of the metal core 32. The polypropyrene cover is relatively thin, thus the metal core can remain bent as the polypropyrene base member is bent.

As shown in FIG. 1 and FIG. 4*b*, the central section 26 includes polypropyrene flanges 36 and 38 extending outwardly from both sides of the central section 26 along substantially the length of the central section 26. The polypropyrene flanges 36 and 38 are bonded to the polypropyrene cover sheet 12 by an ultrasonic bonding. In the illustrated embodiment shown in FIG. 1, the polypropyrene flanges 36 and 38 and the polypropyrene cover at the central section 26 are integrally formed and bonded to the rear wall 22 at spots 40 that are spaced a distance from one another along the length of the central section 26. The central section 26, which includes the polypropyrene cover 34 and the metal core 32, and the polypropyrene flanges 36 and 38 are thicker than the arm sections 28 and 30. Since the flanges 36 and 38 provide a substantially large area for bonding, the base member 16 of the fastener assembly 14 and the polypropyrene cover sheet 12 are securely bonded to one another.

Figure 4C:
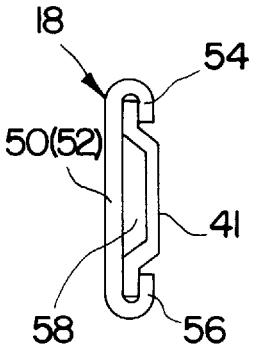
FIG. 4*c* is a cross-sectional view taken along the line 4*c*—4*c* in FIG. 1

The retainer member 18 mates with the arm sections 28 and 30 of the base member 16, respectively. The retainer member 18 includes a generally elongated plate member 41 and apertures 42 and 44 formed adjacent to the ends 46 and 48 of the plate member 41, respectively. Also, the retainer member 18 has a first stopper 50 and a second stopper 52. As shown in FIG. 4*c*, the first and second stoppers 50 and 52 have end sections 54 and 56 that are bent around the edges of the generally elongated plate member 41 so that the first and second stoppers 50 and 52 are slidable along the edges of the elongated plate member 41. A groove 58 is formed generally in parallel to the edges of the elongated plate member 41 for receiving the arm sections 28 and 30 of the base member 16.

When papers (not shown) are bound in the file 10, the arm sections 28 and 30 of the base member 16 are passed through holes (not shown) punched in the paper and then through the apertures 42 and 44 of the retainer member 18, as shown in FIG. 2. The arm sections 28 and 30 are bent into the groove 58, and the stoppers 50 and 52 are slid over the arm sections 28 and 30, respectively, to maintain the bent arm sections 28 and 30 in the groove 58. In FIG. 2, only the arm section 30 is bent and the stopper 52 is slid over the arm section 30.

In the embodiment described the above, the base member 16 is affixed to the inner surface of the rear wall 22, the outer surface of the rear wall 22 (and also the outer surface of the front wall 20) is smooth and entirely flat with nothing projecting from the outer surface of the rear wall 22 (and of the front wall), accordingly, the file can be easily pushed in and pulled out of, for example, a file cabinet, without being caught by other files. In addition, it is possible to avoid injuries to the fingers that might be caused by a metal base member used in the prior art files.

Figure 3:
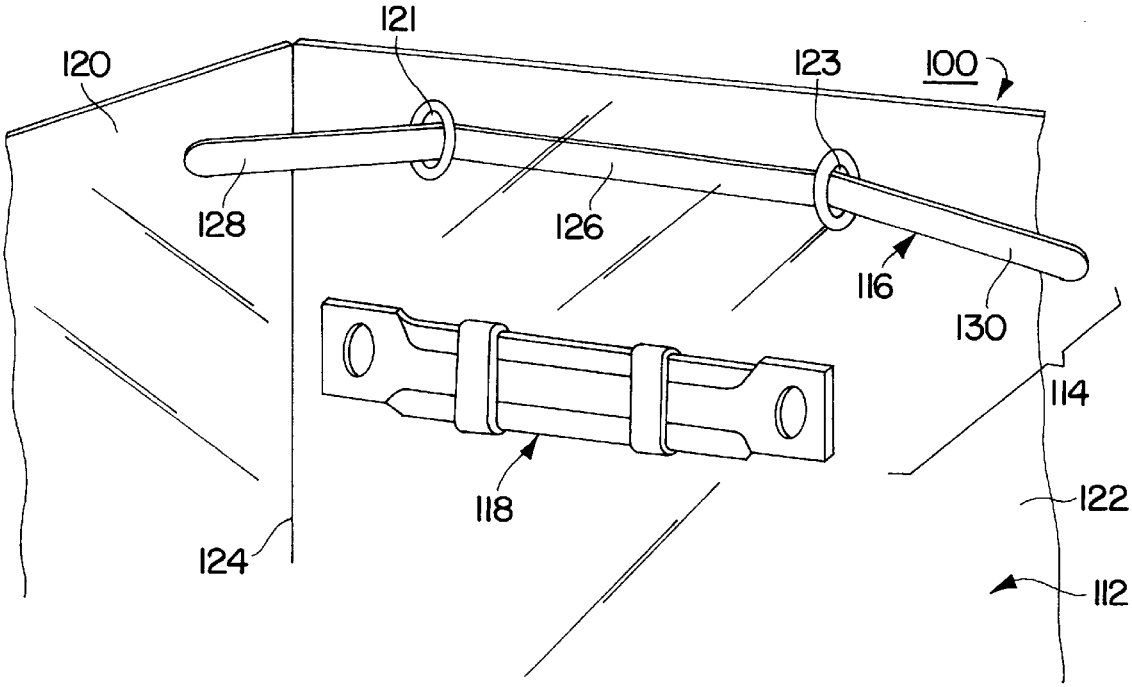
FIG. 3 shows a perspective view of a folder in accordance with a second embodiment of the present invention in which a base member is detached from a mating member.

FIG. 3 shows a file in accordance with a second embodiment of the present invention that is indicated generally at 100.

The file 100 includes a cover sheet 112 and a fastener assembly 114. The fastener assembly 114 comprises a base member 116 and a retainer member 118 that is coupled to the base member 116. The retainer member 118 has a structure similar to that of the first embodiment. Therefore, the detailed description of the retainer member 118 is omitted.

The cover sheet 112 has a front wall 120 and a rear wall 122. The front wall 120 and the rear wall 122 can be folded about a fold line 124. The cover sheet 112 may be made of any one of appropriate sheet materials, such as polypropyrene, vinyl, paper and the like. In the illustrated embodiment shown in FIG. 3, the rear wall 122 defines apertures 121 and 123 for engagement with the base member 116.

The base member 116 includes a central section 126 and arm sections 128 and 130 connected to both ends of the central section 126. The arm sections 128 and 130 are passed through the apertures 121 and 123 of the rear wall 122 and then holes punched in papers (not shown) which are to be filed in the file 100, as shown in FIG. 3. The arm sections 128 and 130 are engaged with the retainer member 118 in a manner similar to the above described first embodiment. Therefore, the description as to the engagement between the arm sections 128 and 130 of the base member 116 and the retainer member 118 is omitted. The base member 116 includes a metal core extending substantially the entire length of the base member 116 and a polypropyrene cover covering substantially the entire surface of the metal core as in the first embodiment. The polypropyrene cover is relatively thin so that the metal core can remain bent when the polypropyrene base member is bent. In the illustrated embodiment shown in FIG. 3, the base member 116 is not fixed to the cover sheet 112. However, the base member 116 may be bonded to the cover sheet 112 by an appropriate means, such as, ultrasonic bonding.

While the description above refers to particular embodiments of the present invention, it will be understood that many modifications may be made without departing from the spirit thereof. For example, in the embodiment shown in FIG. 1, the file 10 has the front wall 20 and the rear wall 22 that are foldable along the fold line 24. However, the file 10 may have only the rear wall 22 that is connected to the fastener assembly 14, and the front wall 20 may be omitted. Moreover, in accordance with the illustrated embodiment, the metal core 34 has generally an uniform width along the entire length thereof. However, the metal core 34 may have a larger width at the central section 26 than at the arm sections 28 and 30.

The embodiments described above are to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A file assembly comprising:

a polypropyrene base sheet; and a fastener including a polypropyrene base member thermally bonded to the polypropyrene base sheet; and wherein:

the polypropyrene base member includes a generally elongated metal strip, the generally elongated metal strip having a first end section, a second end section and a central section which is between the first and second end sections; and further comprising:

a polypropyrene cover covering at least the central section of the generally elongated metal strip, the polypropyrene cover covering the central section of the generally elongated metal strip being thermally bonded to the polypropyrene base sheet.

2. A file assembly comprising:

a polypropyrene base sheet; and a fastener including a polypropyrene base member thermally bonded to the polypropyrene base sheet; and wherein:

the polypropyrene base member includes a generally elongated metal strip, the generally elongated metal strip having a first end section, a second end section and a central section which is between the first and second end sections; and the polypropyrene cover covering the central section of the generally elongated metal strip includes polypropyrene flanges extending outwardly from both sides of the central section of the generally elongated metal strip, and the flanges are thermally bonded to the polypropyrene base sheet.

3. A file assembly comprising:

a polypropyrene base sheet; and a fastener including a polypropyrene base member thermally bonded to the polypropyrene base sheet; and wherein:

the polypropyrene base member includes a generally elongated metal strip, the generally elongated metal strip having a first end section, a second end section and a central section which is between the first and second end sections; and further comprising:

a retainer member to mate with the generally elongated metal member, the retainer member being provided with a first aperture and a second aperture for mating with the first end section and the second end section of the generally elongated metal strip, respectively, and having a first stopper and a second stopper for engaging the first end section and the second end section of the generally elongated metal member, respectively.

4. A file assembly comprising:

a polypropyrene base sheet;

a generally elongated metal strip, the generally elongated metal strip having a first end section, a second end section and a central section which is between the first and the second end sections;

a polypropyrene cover covering substantially an entire surface of the generally elongated metal strip; and a polypropyrene flanges extending outwardly along both sides of the central section of the generally elongated metal strip, the flanges being bonded to the polypropyrene base sheet by an ultrasonic bonding.

5. A file assembly according to claim 4, further comprising a retainer member to mate with the generally elongated metal strip, the retainer member being provided with a first aperture and a second aperture for mating with the first end section and the second end section of the generally elongated metal strip, respectively, and having a first stopper and a second stopper for engaging the first end section and the second end section of the generally elongated metal member, respectively.

6. A fastener assembly for a file comprising:

a generally elongated metal member having first and second end sections and a central section which is between the first and second end sections;

a polypropyrene cover covering substantially an entire surface of the generally elongated metal member; and a retainer member to mate with the generally elongated metal member, the retainer member being provided with a first aperture and a second aperture for mating with the first end section and the second end section of the generally elongated metal member, respectively, and having a first stopper and a second stopper for engaging the first end section and the second end section of the generally elongated metal member, respectively.

7. A method of making a file assembly comprising the steps of:

providing a polypropyrene base sheet;

providing a fastener including a polypropyrene base member; and thermally bonding the polypropyrene base member to the polypropyrene base sheet; and wherein:

the step of providing the fastener includes steps of providing a metal core and covering the metal core by a polypropyrene cover.

* * * * *